US006675966B1

(12) United States Patent
Ray

(10) Patent No.: US 6,675,966 B1
(45) Date of Patent: Jan. 13, 2004

(54) SHUCK FOR DRYING A PAINTBRUSH

(76) Inventor: James L. Ray, 2002 Virginia Blvd., Apt. B, Huntsville, AL (US) 35811

( * ) Notice: Subject to any disclaimer, the term of this patent is extended or adjusted under 35 U.S.C. 154(b) by 0 days.

(21) Appl. No.: 09/840,656

(22) Filed: Apr. 23, 2001

(51) Int. Cl.[7] ..... B65D 65/00
(52) U.S. Cl. ..... 206/362.4
(58) Field of Search ..... 206/15.1, 15.2, 206/361, 362, 362.1–362.4

(56) References Cited

U.S. PATENT DOCUMENTS

| | | | | | |
|---|---|---|---|---|---|
| 1,437,822 | A | * | 12/1922 | Seymour | 206/361 |
| 1,931,293 | A | * | 10/1933 | Morck | 206/362.4 |
| 1,951,576 | A | * | 3/1934 | Lehr | 206/361 |
| 2,290,359 | A | * | 7/1942 | Ringler | 206/362.4 |
| 2,841,273 | A | * | 7/1958 | Scott | 206/362.4 |
| 3,690,448 | A | | 9/1972 | Switzer | 206/15.1 |
| 3,981,399 | A | | 9/1976 | Crouch | 206/15.2 |
| 4,606,456 | A | * | 8/1986 | Kminski | 206/362.4 |
| 4,847,939 | A | | 7/1989 | Derencsenyi et al. | 15/246 |
| 5,007,553 | A | | 4/1991 | Curtis | 220/90 |
| 5,191,973 | A | * | 3/1993 | Shteynberg | 206/362.4 |
| 5,363,959 | A | * | 11/1994 | Crosby et al. | 206/362.4 |
| 5,465,453 | A | | 11/1995 | Landmeier | 15/247 |
| 5,540,363 | A | | 7/1996 | Wilson | 224/148.7 |
| 5,791,608 | A | * | 8/1998 | Nielsen et al. | 206/362.4 |
| 5,797,489 | A | | 8/1998 | Baker | 206/362 |

* cited by examiner

*Primary Examiner*—Jim Foster
(74) *Attorney, Agent, or Firm*—Richard L. Miller

(57) ABSTRACT

An improved shuck for drying a paintbrush of the type having a back panel, a bottom panel, a front panel, a pair of side panels, and a pair of front flaps together defining a chamber having an open top, and a fastener. The improvement includes each of the back panel, the front panel, the pair of side panels, and the pair of front flaps having an air-permeable screen mesh portion for facilitating the drying of the paintbrush. The improvement further includes a top flap having a top portion selectively closing the open top of the chamber and a front portion. The improvement further includes the fastener being a snap having a male portion extending from the front portion of the top flap and a female portion extending from the front panel and selectively engaging the male portion of the snap.

13 Claims, 2 Drawing Sheets

SHUCK FOR DRYING A PAINTBRUSH

BACKGROUND OF THE INVENTION

1. Field of the Invention

The present invention relates to a shuck for drying a paintbrush. More particularly, the present invention relates to an improved shuck for drying a paintbrush.

2. Description of the Prior Art

Numerous innovations for paint brush covers have been provided in the prior art that will be described. Even though these innovations may be suitable for the specific individual purposes to which they address, however, they differ from the present invention.

A FIRST EXAMPLE, U.S. Pat. No. 3,690,448 to Switzer teaches a readily openable, closable and sealable plastic bag that provides an elongated pouch which enables a user to hang and store a wet paint brush therein for days—weeks if necessary. The mouth of the bag embodies quick separable and connectable top and bottom flaps. The top flap is provided with an elongated plaint male keying rib which snaps into a yieldable female keeper groove. When the rib is snapped into the groove the brush storing pouch is airtight. An eye fixed in one end of the bag permits hanging the bag on a fixed nail. This eye is provided with a brush hanging wire which has a hook to suspend the apertured end of the brush handle. The narrow rib-equipped-flap has a red marker strip bordering its free edge. Life the "red" flap to open the bag and press the rib into the groove to close and seal the bag. The wet brush is preserved for ready re-use whenever necessary or desired.

A SECOND EXAMPLE, U.S. Pat. No. 3,981,399 to Crouch teaches an apparatus for holding and storing a paint brush. A variety of embodiments include a box assembly having a V-shaped interior wall to complementarily receive the bristled end of a paint brush. The box assembly includes an opening through which the handle of the paint brush projects. In one embodiment, the box assembly includes an inner box slidably mounted within an outer box. The V-shaped wall is an insert which is positionable within the inner box along with the paint brush. Slots in both boxes allow the paint brush handle to project externally of the assembly. Flanges on the insert limit relative movement of the paint brush and insert relative to the boxes. In another embodiment, the insert is centered in a V-shaped groove provided on a cap mountable to a box. In another embodiment, the insert is positionable within a,box having the hinged lid with a V-shaped groove provided thereon to center the insert. In another embodiment, the V-shaped wall includes a pair of walls fixedly mounted respectively to an inner and outer box with the walls converging, when the inner box is positioned within the outer box.

A THIRD EXAMPLE, U.S. Pat. No. 4,847,939 to Derencsenyi et al. teaches a sleeve device for protecting paintbrushes during soaking and storage that comprises a resilient, generally rectangular body portion, having front and back faces, left and right sides, and a bottom opening, dimensioned to receive the brush stock and bristles; a neck portion having front and back faces continuous with the body portion's front and back faces, dimensioned to receive the brush handle; a shoulder region connecting the top of the body portion with the neck portion; and friction/elastic-retaining means for releasably engaging the brush stock, brush handle, or both. The friction/elastic-retaining means preferably comprise internally-projecting ridges positioned on the left and right sides of the body portion and oriented parallel to the left and right sides, where the ridges exhibit a maximal intrusion near the shoulder region of the left and right faces, and decline to a minimal intrusion near the bottom opening.

A FOURTH EXAMPLE, U.S. Pat. No. 5,007,553 to Curtis teaches a container for a paint brush, which container comprises a body and a lid, the body having a base and a walled portion which upstands from the base, the lid having an aperture through which a handle of the paint brush passes and slits which extend from the aperture and which enables parts of the lid defining the aperture to grip the handle of the paint brush, and the walled portion of the body having an inwardly projecting integrally formed shelf portion on which to rest the paint brush, and integrally formed ribs which extend parallel to the base and which are for wiping excess paint from the paint brush.

A FIFTH EXAMPLE, U.S. Pat. No. 5,465,453 to Landmeier teaches a paint brush protective cover for protecting the bristles of a paint brush comprising a flexible cover and a hard cover. The flexible cover further comprising a plurality of flaps that are wrapped around the bristles of the paint brush and secured together. The flexible cover further comprising a plurality of vent openings and a handle opening to allow a paint brush handle to be inserted therein. After the flexible cover is installed over the bristles of the paint brush, a hard cover is slipped over the flexible cover and locked in place by a top lid to complete the task.

A SIXTH EXAMPLE, U.S. Pat. No. 5,540,363 to Wilson teaches a container for temporarily holding and storing a wet paintbrush that will maintain the paintbrush in a useful condition for a limited period of time up to several days. The container has the shape, substantially rectangular box. The container is formed from two shallow, rectangular members that are hingedly attached to each other along respective longitudinal edges of the rectangular members. The two shallow members open so as to allow positioning a paintbrush therein, and the shallow members can be closed upon each in clam shell fashion to close the container. An opening is provided in the top wall of the container to allow the handle of a paintbrush to extend from the container. Each shallow member has a layer of closed cell foam material positioned along the inside of the upper wall of the shallow member. The layers of closed cell foam material seal around the handle of a paintbrush when the shallow members move to their closed position with the handle of the paintbrush extending from the opening in the top wall of the container. A layer of open cell foam material is provided along the inside surface of the lower wall of each shallow member. The layers of open cell foam material absorb paint drippings from the paintbrush. The layers of open cell foam material can also contain a small amount of solvent for the paint.

A SEVENTH EXAMPLE, U.S. Pat. No. 5,797,489 to Baker teaches a paintbrush case that has a selection of paintbrushes hanging with brush handles and having sides that open downwardly to reveal brush bristles and to provide convenient access while the case stands reliably where positioned. Air vents in tops and bottoms of the case aid drying of the brushes after they have been cleaned and prevent buildup of expanded gases from paint. In addition to convenience and efficiency for professional and do-it-yourself painters alike, a major use of this paintbrush case is keeping track of and caring for paintbrushes at construction sites.

The configuration of a prior art shuck 10 for drying a paintbrush 12 having bristles 14, a stock 16, and a handle 18, of which the present invention is an improvement of, can best be seen in FIGS. 1–3, and as such, will be discussed with reference thereto.

The shuck 10 is sold by SHERWIN-WILLIAMS(R) of the Sherwin Williams Company of Cleveland, Ohio 44101.

The shuck 10 comprises a back panel 20 being rectangular-shaped and having a pair of long side edges 22 being straight, a short bottom edge 24 being straight and shorter than each of the pair of long side edges 22 thereof, and a short top edge 25 being free, straight, and shorter than each of the pair of long side edges 22 thereof.

The shuck 10 further comprises a bottom panel 26 being rectangular-shaped and having a long inner edge 28 being straight and coincident with, and forming a fold line with, the short bottom edge 24 of the back panel 20 thereof so as to allow, the bottom panel 26 thereof to fold perpendicularly forwardly from the back panel 20 thereof, a long outer edge 30 being straight, and a pair of short side edges 31 being free and shorter than the long outer edge 30 of the bottom panel 26 thereof.

The shuck 10 further comprises a front panel 32 being rectangular-shaped and having a pair of long side edges 33 being free and straight, a short bottom edge 34 being straight, shorter than each of the pair of long side edges 33 thereof, and coincident with, and forming a fold line with, the long outer edge 30 of the bottom panel 26 thereof so as to allow the front panel 32 thereof to fold perpendicularly upwardly from the bottom panel 26 thereof, and a short top edge 36 being free and straight.

The shuck 10 further comprises a pair of side panels 38, each of which being isosceles triangular-shaped and truncated.

Each side panel 32 having a first leg 40 being straight and coincident with, and forming a fold line with, an associated long side edge 22 of the back panel 20 so as to allow the pair of side panels 38 to fold perpendicularly forwardly from the back panel 20, a second leg 42 being straight, a base 44 being free, straight, and extending continuously from the short top edge 25 of the back panel 20, and a truncated apex 46 being free, straight, and extending continuously from the short bottom edge 24 of the back panel 20.

The shuck 10 further comprises a pair of front flaps 48, each of which being rectangular-shaped.

Each front flap 48 having a long inner edge 50 being straight and coincident with, and forming a fold line with, the second leg 42 of an associated side panel 38 so as to allow the pair of front flaps 48 to fold perpendicularly inwardly from the pair of side panels 38 and overlap each other under the front panel 32 so as to form therewith a chamber 51 with an open top 53 for capturing the bristles 14 and the stock 16 of the paintbrush 12 therein while allowing the handle 18 of the paintbrush 12 to extend upwardly through the open top 53 thereof.

Each front flap 48 further having a long outer edge 52 being free and straight, a top short edge 54 being free, straight, shorter than the long outer edge 52 thereof, and extending continuously from the base 44 of an associated side panel 38, and a short bottom edge 56 being free, straight, shorter than the long outer edge 52 thereof, and extending continuously from the apex 46 of an associated side panel 38.

The shuck 10 further comprises a fastener 58 associated with at least the front panel 32, and when fastened, maintains the paintbrush 12 in the shuck 10.

It is apparent that numerous innovations for paint brush covers have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide an improved shuck for drying a paintbrush that avoids the disadvantages of the prior art.

ANOTHER OBJECT of the present invention is to provide an improved shuck for drying a paintbrush that is simple and inexpensive to manufacture.

STILL ANOTHER OBJECT of the present invention is to provide an improved shuck for drying a paintbrush that is simple to use.

BRIEFLY STATED, STILL YET ANOTHER OBJECT of the present invention is to provide an improved shuck for drying a paintbrush of the type having a back panel, a bottom panel, a front panel, a pair of side panels, and a pair of front flaps together defining a chamber having an, open top, and a fastener The improvement includes each of the back panel, the front panel, the pair of side panels, and the pair of front flaps having an air-permeable screen mesh portion for facilitating the drying of the paintbrush. The improvement further includes a top flap having a top portion selectively closing the open top of the chamber and a front portion. The improvement further includes the fastener being a snap having a male portion extending from the front portion of the top flap and a female portion extending from the front,panel and selectively engaging the male portion of the snap.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described, as follows.

LIST OF REFERENCE NUMERALS UTILIZED IN THE DRAWING

Prior Art

Figure 1:
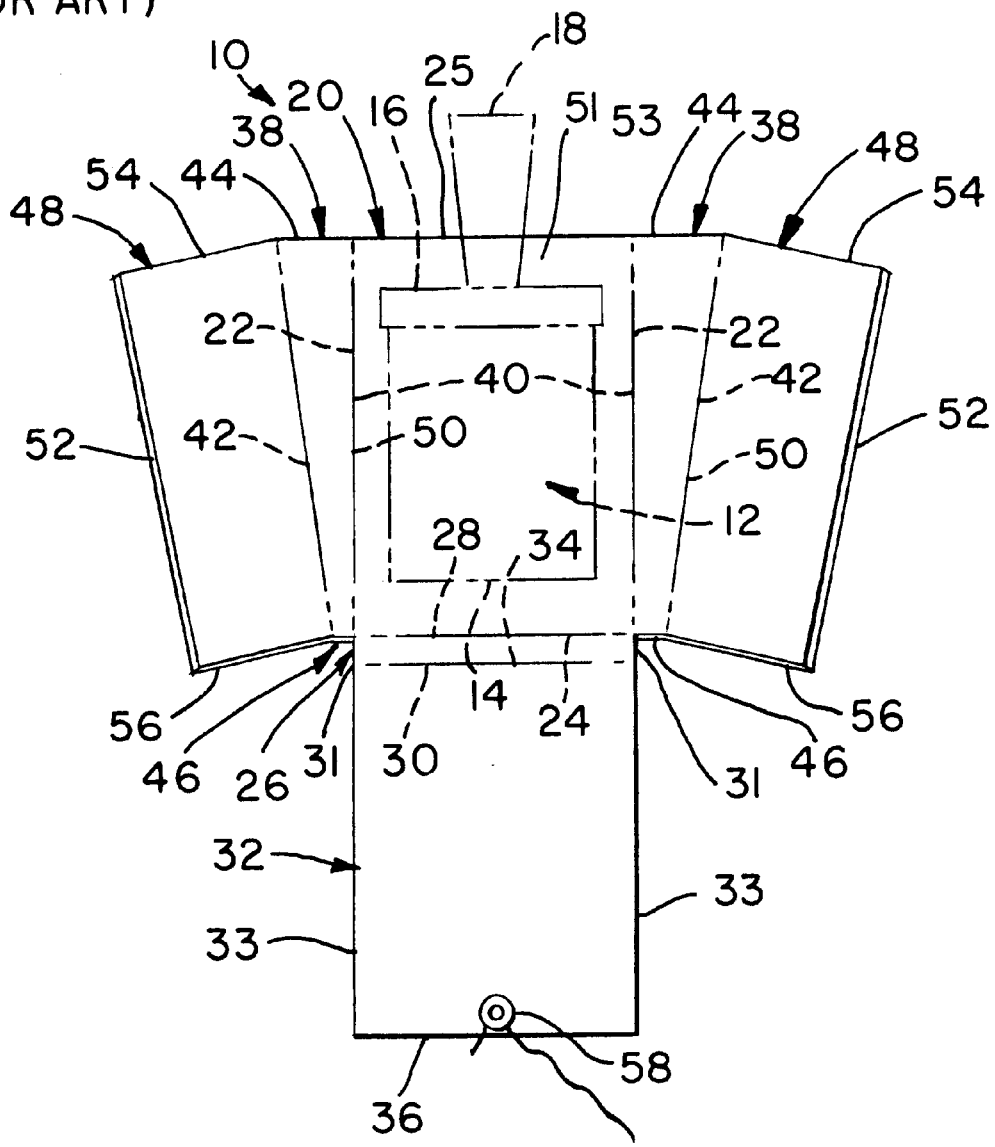
FIG. 1 (PRIOR ART)
FIG. 1 is a diagrammatic plan view of a prior art shuck for drying a paintbrush prior to use.

10 shuck for drying paintbrush 12
14 bristles of paintbrush 12

16 stock of paintbrush 12
18 handle of paintbrush 12
20 back panel
22 pair of long side edges of back panel 20
24 short bottom edge of back panel 20
25 short top edge of back panel 20
26 bottom panel
28 long inner edge of bottom panel 26
30 long outer edge of bottom panel 26
31 pair of short side edges of bottom panel 26
32 front panel
33 pair of long side edges of front panel 32
34 short bottom edge of front panel 32
36 short top edge of front panel 32
38 pair of side panels
40 first leg of each side panel of pair of side panels 32
42 second leg of each side panel of pair of side panels 32
44 base of each side panel of pair of side panels 32
46 truncated apex of each side panel of pair of side panels 32
48 pair of front flaps
50 long inner edge of each front flap of pair of front flaps 48
51 chamber for capturing bristles 14 of paintbrush 12 and stock 16 of
paintbrush 12 therein
52 long outer edge of each front flap of pair of front flaps 48
53 open top of chamber 51 for allowing handle 18 of paintbrush 12 to extend upwardly therethrough
54 short top edge of each front flap of pair of front flaps 48
56 short bottom edge of each front flap of pair of front flaps 48
58 fastener First Embodiment

60 improved shuck of present invention for drying paintbrush 12
62 air-permeable screen mesh portion in back panel 20 for facilitating drying of paintbrush 12
64 air-permeable screen mesh portion in each side panel of pair of side panels 38 for facilitating drying of paintbrush 12
66 air-permeable screen mesh portion in each front flap of pair of front flaps 48 for facilitating drying of paintbrush 12
68 air-permeable screen mesh portion in front panel 32 for facilitating drying of paintbrush 12

Second Embodiment

160 improved shuck of present invention for drying paintbrush 12
170 top flap
172 top portion of top flap 170
174 front portion of top flap 170
176 long inner edge of top portion 172 of top flap 170
178 long outer edge of top portion 172 of top flap 170
180 pair of short side edges of top portion 172 of top flap 170
182 throughbore extending centrally through top portion 172 of top flap 170 for receiving handle 18 of paintbrush 12
184 long top edge of front portion 174 of top flap 170
186 long bottom edge of front portion 174 of top flap 170
188 pair of short side edges of front portion 174 of top flap 17O
190 snap of fastener 58
192 male portion of snap 190 of fastener 58
194 female portion of snap 190 of fastener 58

DETAILED DESCRIPTION OF THE PREFERRED EMBODIMENT

Figures 2, 3, 4, 5, 6, 7, 8:
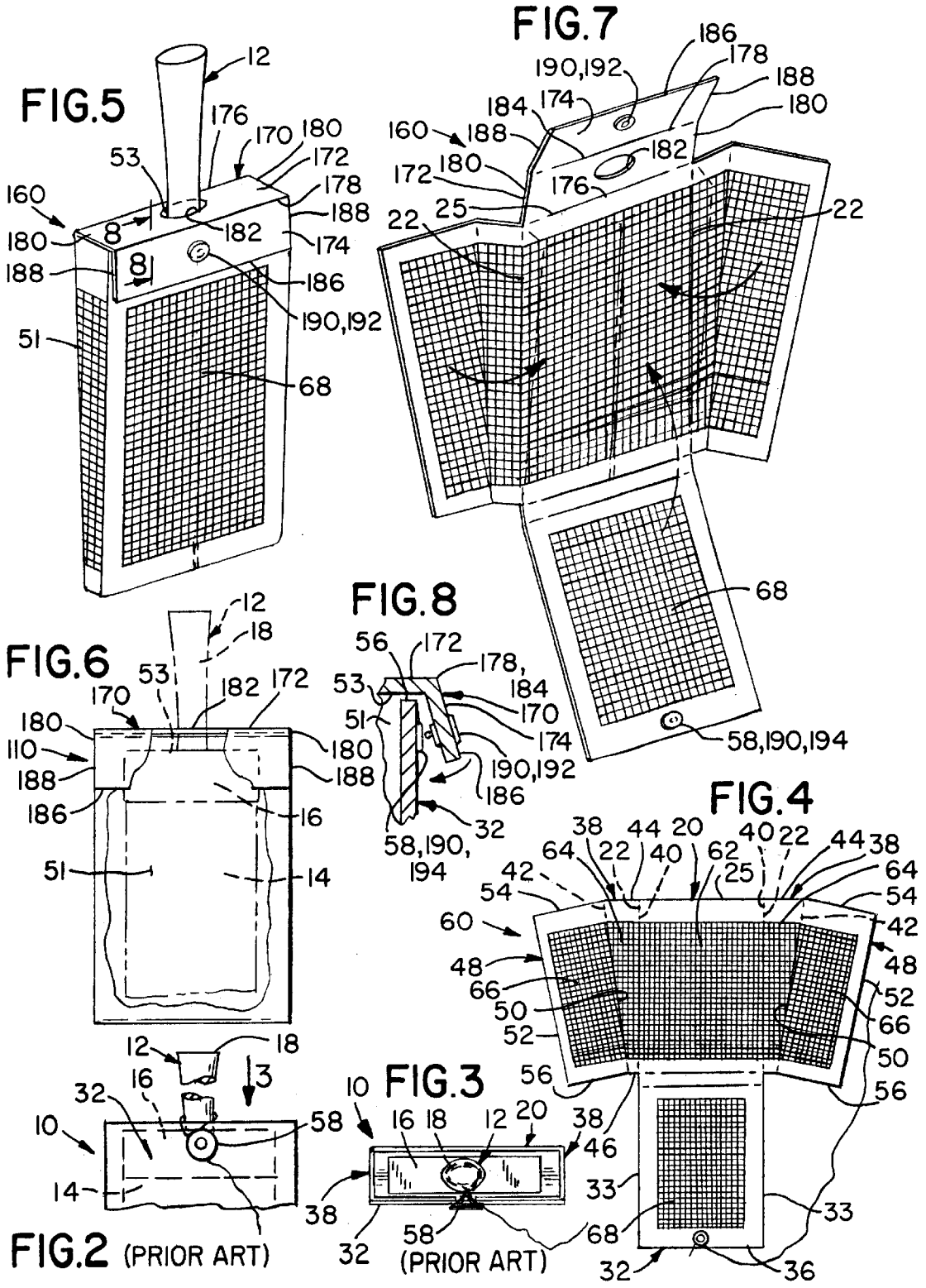
FIG.2 (PRIOR ART) (PRIOR ART)
FIG. 2 is a fragmented diagrammatic front elevational view of the prior art shuck for drying a paintbrush shown in FIG. 1 in use.
FIG. 3 is a diagrammatic top plan view taken generally in the direction of arrow 3 in FIG. 2.
FIG. 4 is a diagrammatic plan view of a first embodiment of the present invention prior to use.
FIG. 5 is a diagrammatic perspective view of a second embodiment of the present invention in use.
FIG. 6 is a fragmented diagrammatic front elevational view of the second embodiment of the present invention in use.
FIG. 7 is a diagrammatic perspective view of the second embodiment of the present invention prior to use.
FIG. 8 is a diagrammatic cross sectional view taken on line 8—8 in FIG. 5.

Referring now to the figures, in which like numerals indicate like parts, and particularly to FIG. 4, a first embodiment of the improved shuck of the present invention is shown generally at 60 for drying the paintbrush 12.

The improvement comprises the back panel 20 having an air-permeable screen mesh portion 62 for facilitating the drying of the paintbrush 12.

The improvement further comprises the air-permeable screen mesh portion 62 of the back panel 20 extending continuously from one long side edge 22 thereof to the other long side edge 22 thereof and from just below the short top edge 25 thereof to just above the short bottom edge 24 thereof.

The improvement further comprises each side panel 38 having an air-permeable screen mesh portion 64 for facilitating the drying of the paintbrush 12.

The improvement further comprises the air-permeable screen mesh portion 64 of an associated side panel 38 extending continuously from the first leg 40 thereof to the second leg 42 thereof and from just below the base 44 thereof to just above the truncated apex 46 thereof.

The improvement further comprises the, air-permeable screen mesh portion 64 of each side panel 38 being continuous with the air-permeable screen mesh portion 62 of the back panel 20.

The improvement further comprises each front flap 48 having an air-permeable screen mesh portion 66 for facilitating the drying of the paintbrush 12.

The improvement further comprises the air-permeable screen mesh portion 66 of an associated front flap 48 extending continuously from the long inner edge 50 thereof to just inward of the long outer edge 52 thereof and from just below the short top edge 54 thereof to just above the short bottom edge 56 thereof.

The improvement further comprises the air-permeable screen mesh portion 66 of each front flap 48 being continuous with the air-permeable screen mesh portion 64 of an adjacent side panel 38.

The improvement further comprises the front panel 32 having an air-permeable screen mesh portion 68 for facilitating the drying of the paintbrush 12.

The improvement further comprises the air-permeable screen mesh portion 68 of the front panel 32 extending continuously from just inward of one long side edge 33 thereof to just inward of the other long side edge 33 thereof and from just below the short top edge 36 thereof to just above the short bottom edge 34 thereof.

The improvement further comprises the air-permeable screen mesh portion 68 of the front panel 32 being concentrically disposed in the front panel 32.

A second embodiment of the improved shuck 160 for drying a paintbrush 12 can best be seen in FIGS. 5–8, and as such, will be discussed with reference thereto.

The improvement further comprises a top flap 170 being rectangular-shaped.

The improvement further comprises the top flap 170 having a top portion 172 and a front portion 174.

The improvement further comprises the top portion 172 of the top flap 170 being rectangular-shaped and selectively closing the open top 53 of the chamber 51.

The improvement further comprises the top portion 172 of the top flap 170 having a long inner edge 176 being straight and coincident with, and forming a fold line with, the short top edge 25 of the back panel 20 so as to allow the top portion 172 of the top flap 170 to fold perpendicularly forwardly from the back panel 20, a long outer edge 178 being straight, and a pair of short side edges 180, each of which being free, shorter than the long outer edge 178 thereof, and continuous with an associated long side edge 22 of the back panel 20.

The improvement further comprises the top portion 172 of the top flap 170 having a throughbore 182 extending centrally therethrough for receiving the handle 18 of the paintbrush 12.

The improvement further comprises the front portion 174 of the top flap 170 being rectangular-shaped.

The improvement further comprises the front portion 174 of the top flap 170 having a long top edge 184 being straight and coincident with, and forming a fold line with, the long outer edge 178 of the top portion 172 of the top flap 170 so as to allow the front portion 172 of the top flap 170 to fold perpendicularly downwardly from the top portion 172 of the top flap 170 and overlap the short top edge 36 of, and onto, the front panel 32, but short of, so as not to obscure, the air-permeable screen mesh portion 68 of the front panel 32, a long bottom edge 186 being straight and free, and a pair of short side edges 188, each of which being free, straight, shorter than the long bottom edge 186 thereof, and continuous with an associated short side edge 180 of the top portion 172 of the top flap 170.

The improvement further comprises the fastener 58 being a snap 190 having a male portion 192 extending rearwardly and centrally from the front portion 174 of the top flap 170 and a female portion 194 extending forwardly from the front panel 32, just below the short top edge 36 of the front panel 32, and selectively engaging the male portion 192 of the snap 190.

It will be understood that each of the elements described above, or two or more together, may also find a useful, application in other types of constructions differing from the types described above.

While the invention has been illustrated and described as embodied in an improved shuck for drying,a paintbrush, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An improved shuck for drying a paintbrush having bristles and a stock and a handle, of the type having:

A) a back panel being rectangular-shaped and having:
- i) a pair of long side edges being straight;
- ii) a short bottom edge being straight and shorter than each of the pair of long side edges thereof; and
- iii) a short top edge being free, straight, and shorter than each of the pair of long side edges thereof;

B) a bottom panel being rectangular-shaped and having:
- i) a long inner edge being straight and coincident with, and forming a fold line with, the short bottom edge of the back panel thereof so as to allow the bottom panel thereof to fold perpendicularly forwardly from the back panel thereof;
- ii) a long outer edge being straight; and
- iii) a pair of short side edges being free and shorter than the long outer edge of the bottom panel thereof;

C) a front panel being rectangular-shaped and having:
- i) a pair of long side edges being free and straight;
- ii) a short bottom edge being straight, shorter than each of the pair of long side edges thereof, and coincident with, and forming a fold line with, the long outer edge of the bottom panel thereof so as to allow the front panel thereof to fold perpendicularly upwardly from the bottom panel thereof; and
- iii) a short top edge being free and straight;

D) a pair of side panels, each of which being isosceles triangular-shaped, truncated, and having:
- i) a first leg being straight and coincident with, and forming a fold line with, an associated long side edge of the back panel so as to allow the pair of side panels to fold perpendicularly forwardly from the back panel;
- ii) a second leg being straight;
- iii) a base being free, straight, and extending continuously from the short top edge of the back panel; and
- iv) a truncated apex being free, straight, and extending continuously from the short bottom edge of the back panel;

E) a pair of front flaps, each of which being rectangular-shaped and having:
- i) a long inner edge being straight and coincident with, and forming a fold line with, the second leg of an associated side panel so as to allow the pair of front flaps to fold perpendicularly inwardly from the pair of side panels and overlap each other under the front panel so as to form therewith a chamber with an open top for capturing the bristles and the stock of the paintbrush therein while allowing the handle of the paintbrush to extend upwardly through the open top thereof;
- ii) a long outer edge being free and straight;
- iii) a short top edge being free, straight, shorter than the long outer edge thereof, and extending continuously from the base of an associated side panel; and
- iv) a short bottom edge being free, straight, shorter than the long outer edge thereof, and extending continuously from the apex of an associated side panel; and F) a fastener associated with at least the front panel, and when fastened, maintaining the paintbrush in the shuck; said improvement comprising the back panel having an air-permeable screen mesh portion for facilitating the drying of the paintbrush, wherein said improvement further comprises the front panel having an air-permeable screen mesh portion for facilitating the drying of the paintbrush, a top flap being rectangular-shaped, said top flap having:
- i) a top portion; and
- ii) a front portion, wherein said improvement further comprises said top portion of said top flap having:
  - I) a long inner edge being straight and coincident with, and forming a fold line with, the short top edge of the back panel 50 to allow said top portion of said top flap to fold perpendicularly forwardly from the back panel;
  - II) a long outer edge being straight; and
  - III) a pair of short side edges, each of which being free, shorter than the long outer edge thereof, and continuous with an associated long side edge of the back panel, wherein said improvement further comprises said front portion of said top flap being rectangular-shaped, wherein said improvement further comprises said front portion of said top flap having:

G) a long top edge being straight and coincident with, and forming a fold line with, said long outer edge of said top portion of said top flap so as to allow said front portion of said top flap to fold perpendicularly downwardly from said top portion of said top flap and overlap the short top edge of, and onto, the front panel, but short of, so as not to obscure, the air-permeable screen mesh portion in the front panel;

H) a long bottom edge being straight and free; and

I) a pair of short aide edges, each of which being free, shorter than said long bottom edge thereof, and continuous with an associated short side edge of said top portion of said top flap.

2. The improved shuck as defined in claim 1, wherein said improvement further comprises said air-permeable screen mesh portion of the back panel extending continuously from one long side edge thereof to the other long side edge thereof and from just below the short top edge thereof to just above the short bottom edge thereof.

3. The improved shuck as defined in claim 1, wherein said improvement further comprises each side panel having an air-permeable screen mesh portion for facilitating the drying of the paintbrush.

4. The improved shuck as defined in claim 3, wherein said improvement further comprises said air-permeable screen mesh portion of an associated side panel extending continuously from the first leg thereof to the second leg thereof and from just below the base thereof to just above the truncated apex thereof.

5. The improved shuck as defined in claim 3, wherein said improvement further comprises said air-permeable screen mesh portion of each side panel being continuous with said air-permeable screen mesh portion of the back panel.

6. The improved shuck as defined in claim 3, wherein said improvement further comprises each front flap having an air-permeable screen mesh portion for facilitating the drying of the paintbrush.

7. The improved shuck as defined in claim 6, wherein said improvement further comprises said air-permeable screen mesh portion of an associated front flap extending continuously from the long inner edge thereof to just inward of the long outer edge thereof and from just below the short top edge thereof to just above the short bottom edge thereof.

8. The improved shuck as defined in claim 6, wherein said improvement further comprises said air-permeable screen mesh portion of each front flap being continuous with said air-permeable screen mesh portion of an adjacent side panel.

9. The improved shuck as defined in claim 1, wherein said improvement further comprises said air-permeable screen mesh portion of the front panel extending continuously from just inward of one long side edge thereof to just inward of the other long side edge thereof and from just below the short top edge thereof to just above the short bottom edge thereof.

10. The improved shuck as defined in claim 1, wherein said improvement further comprises said air-permeable screen mesh portion of the front panel being concentrically disposed in the front panel.

11. The improved shuck as defined in claim 1, wherein said improvement further comprises said top portion of said top flap being rectangular-shaped and selectively closing the open top of the chamber.

12. The improved shuck as defined in claim 1, wherein said improvement further comprises said top portion of said top flap having a throughbore extending centrally therethrough for receiving the handle of the paintbrush.

13. The improved shuck as defined in claim 1, wherein said improvement further comprises the fastener being a snap having:

a) a male portion extending rearwardly and centrally from said front portion of said top flap; and b) a female portion extending forwardly from the front panel, just below the short top edge of the front panel, and selectively engaging said male portion of said snap.

* * * * *